US005722435A

United States Patent [19]

Harris

[11] Patent Number: 5,722,435

[45] Date of Patent: Mar. 3, 1998

[54] NAIL CLIPPER FOR CLIPPING AND DIRECTING THE DISCHARGE OF CLIPPED NAILS

[76] Inventor: David G. Harris, 102 Sellers La., Port Matilda, Pa. 16870

[21] Appl. No.: 802,587

[22] Filed: Feb. 19, 1997

[51] Int. Cl.[6] ..... A45D 29/02

[52] U.S. Cl. ..... 132/75.5; 30/28

[58] Field of Search ..... 132/75, 75.5, 75.4; 30/28

[56] References Cited

U.S. PATENT DOCUMENTS

| | | | |
|---|---|---|---|
| 846,565 | 3/1907 | Havell | 132/75.5 |
| 2,664,624 | 1/1954 | Bassett | 30/28 |
| 3,188,737 | 6/1965 | Chase | 30/28 |
| 3,744,131 | 7/1973 | Manes | 30/28 |
| 3,986,257 | 10/1976 | Kiura | 30/28 |
| 4,380,120 | 4/1983 | Hannon | 30/28 |
| 4,640,011 | 2/1987 | Gamble | 30/28 |
| 4,644,644 | 2/1987 | Elsholz | 30/28 |
| 4,731,927 | 3/1988 | Wilson | 30/28 |
| 4,982,747 | 1/1991 | Shah | 30/28 |
| 4,996,771 | 3/1991 | Williams | 30/28 |
| 5,010,644 | 4/1991 | Goench | 30/28 |
| 5,226,849 | 7/1993 | Johnson | 30/28 |
| 5,392,518 | 2/1995 | Means | 30/28 |

*Primary Examiner*—Paul J. Hirsch

[57] ABSTRACT

An improved nail clipper which controls and directs the discharge of clipped nails. The key improvements consist of convexly shaped sides (42, 44) attached to the upper member (12) and concave relief cuts (50, 51) in the edges of the lower elongated member. This controls the random discharge of the clipped nails and causes the them to automatically be discharged out the bottom of the nail clipper through the openings (52, 54) formed between the convexly shaped sides of the upper member (42, 44) and the concave relief cuts in the lower member (50, 51).

1 Claim, 6 Drawing Sheets

NAIL CLIPPER FOR CLIPPING AND DIRECTING THE DISCHARGE OF CLIPPED NAILS

BACKGROUND AND SUMMARY OF THE INVENTION

This invention relates to an improved nail clipper design and the like.

A typical nail clipper comprises first and second elongated members which are joined at one end so that cutting edges at the opposite end are spaced apart approximately a quarter of an inch in cutting relationship. A small lever typically is mounted near the cutting end and extending rearwardly so that the free end of the lever and joined ends of the elongated members may be squeezed together in such a way as to force the cutting edges against one another.

While this device is quite effective as a nail clipper and simple and inexpensive to manufacture, the problem with it—as known by anyone who has used it and by anyone who has cleaned up there after—is that nail clippings tend to fly about uncontrolled.

Other embodiments of the nail clipper feature a variety of containment devices so that the discharge of clipped nails is captured and stored for later disposition. These devices tend to be cumbersome to use and expensive to manufacture.

The present invention is related to an improvement in the nail clipper which controls and directs the discharge of clipped nails without storing them. It is the basic theme of this invention that persons who do not desire to have nail clippings flying about also do not want to store their clipped nails and that they do not want to have to shake the nail clipper to discharge the clippings. Rather this invention, in accordance with its preferred embodiment with convex flared sides and concave relief cuts in the lower member, controls the flow of nail clippings by directing them straight downward. This simplifies their use, does not require shaking the nail clipper to discharge the clippings, and is not difficult to clean or constitute a potentially unhealthful storage bin for discarded nail clippings. This device is simple and inexpensive to manufacture. It also simplifies the process of cleaning the nail clipper and of removing any stuck nail clippings from the device.

BRIEF DESCRIPTION OF DRAWINGS

These and other objects, features and advantages of the invention will be more readily apparent from the following drawings and accompanying detailed description of a preferred embodiment of the invention in which.

DETAILED DESCRIPTION OF THE PREFERRED EMBODIMENT

Figure 1:
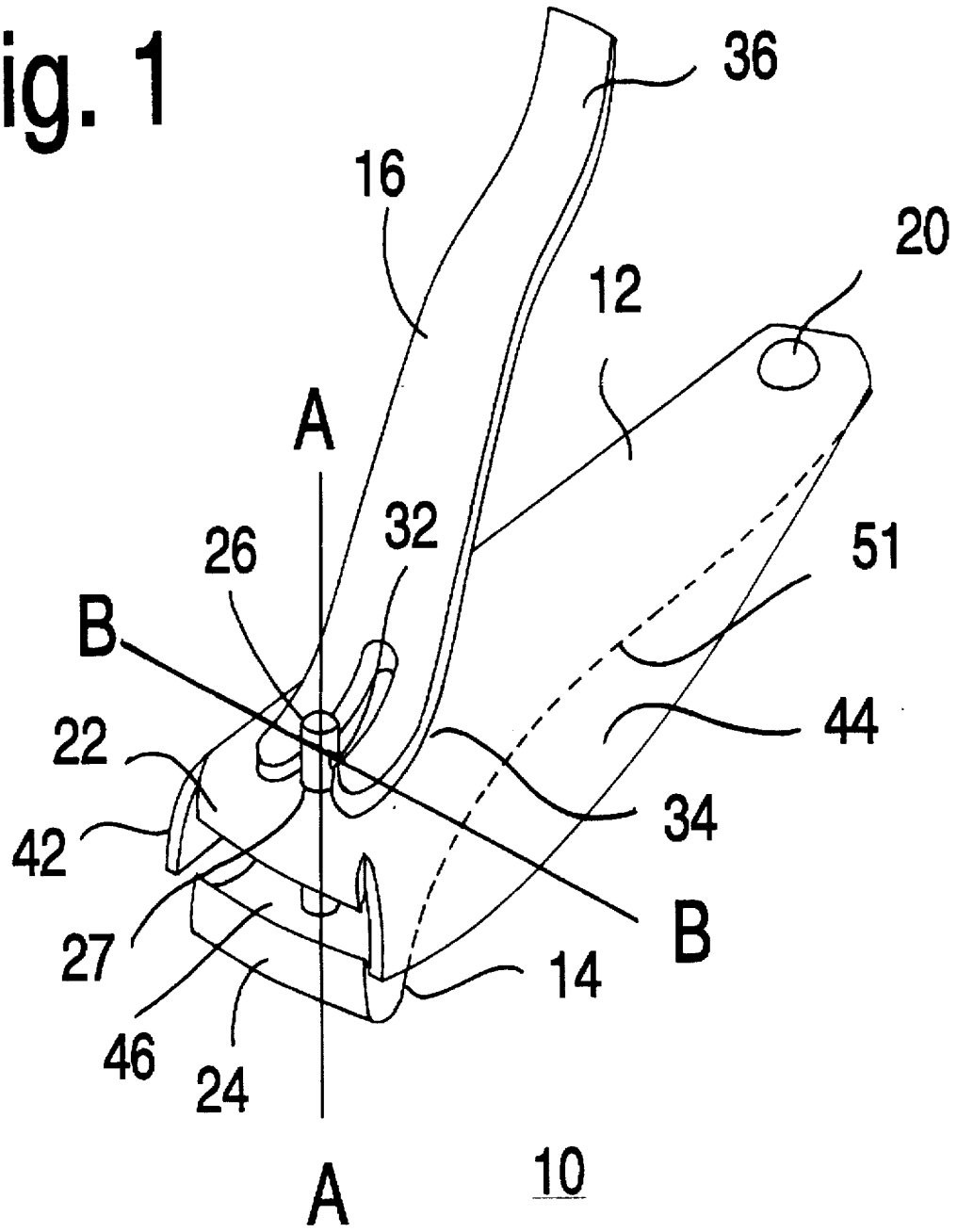
FIG. 1 is a perspective view of a preferred embodiment of the invention.

As shown in FIG. 1, a nail clipper 10 comprises the upper and lower resilient elongated members 12, 14 and a lever 16.

Members 12, 14 are joined together at one end 20 to form a V-shaped structure whose second ends may be urged together against the resiliency of members 12, 14. Cutting edges 22, 24, respectively, are located at the second end of each of the elongated members 12, 14. Illustratively, each cutting edge is integral with an elongated member, but other arrangements can be used if desired.

Lever arm 16 is secured to the nail clipper by a post 26 which is mounted on the elongated arm 14 and extends through a hole 27 in elongated arm 12. Lever arm 16 is mounted in a notch 32 in post 26 so that the lever can be related about an axis A—A pirpendicular to axis B—B of post 26. As indicated, lever arm 16 is L shaped so as to define a corner 34 toward end 20 of elongated members 12, 14, lever 16 pivots in notch 32 and corner 34 drives the elongated member 12 toward elongated member 14. As a result, cutting edges 22, 24 are brought into contact with sufficient mechanical advantage so as to cut a nail inserted in between the cutting edges 46. Upon releasing pressure on free end 36 and joined end 20, the resiliency of members 12, 14 separates the cutting edges 22, 24.

As will be familiar to those who have used such nail clippers, post 26 is rotatably mounted in member 14 and hole 27 so that the position of lever arm 16 can be rotated 180 degrees about the axis of post 26 and the lever arm then folded down over the top of post 26 into contact with the upper surface of member 12.

The foregoing construction and operation is part of the prior art.

Figure 2:
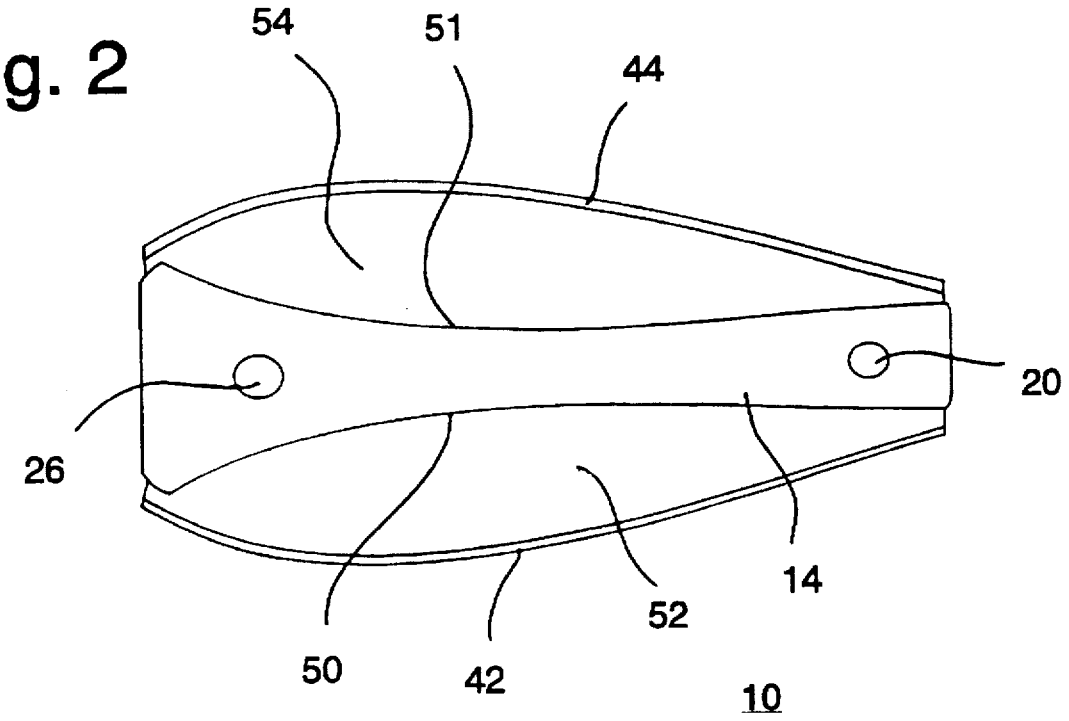
FIG. 2 is a view of a preferred embodiment of the invention from the bottom.

As will be recognized by those who have used such a device, the forces generated when cutting a nail are sufficient to launch nail clippings a considerable distance. In accordance with the invention, the side openings between the upper 12 and lower 14 elongated members are blocked but not fully enclosed by convexly shaped and outwardly angled material 42, 44. These convex sides can be of integral construction with the upper elongated member 12 or they can be comprised of other additional material, flexible or rigid and attached to the upper or lower elongated members 12, 14. Thus, sides 42, 44, each constitute obstructions in the path of flying nail clippings, preventing them from exiting the nail clipper either upwards or directly to the sides and deflecting them downward. Lower elongated member 14 has concave relief cuts on its edges 50, 51 as shown in FIG. 2 to further ease the passage of nail clippings from the nail clipper in a downward direction. Thus, the convexly shaped sides 42, 44 constitute deflecting surfaces the lower edges of which in conjunction with the concave relief cuts in elongated member 14 together comprise two openings 52, 54, seen in FIG. 2, through which cut nails may exit the nail clipper without impediment.

Figure 3:
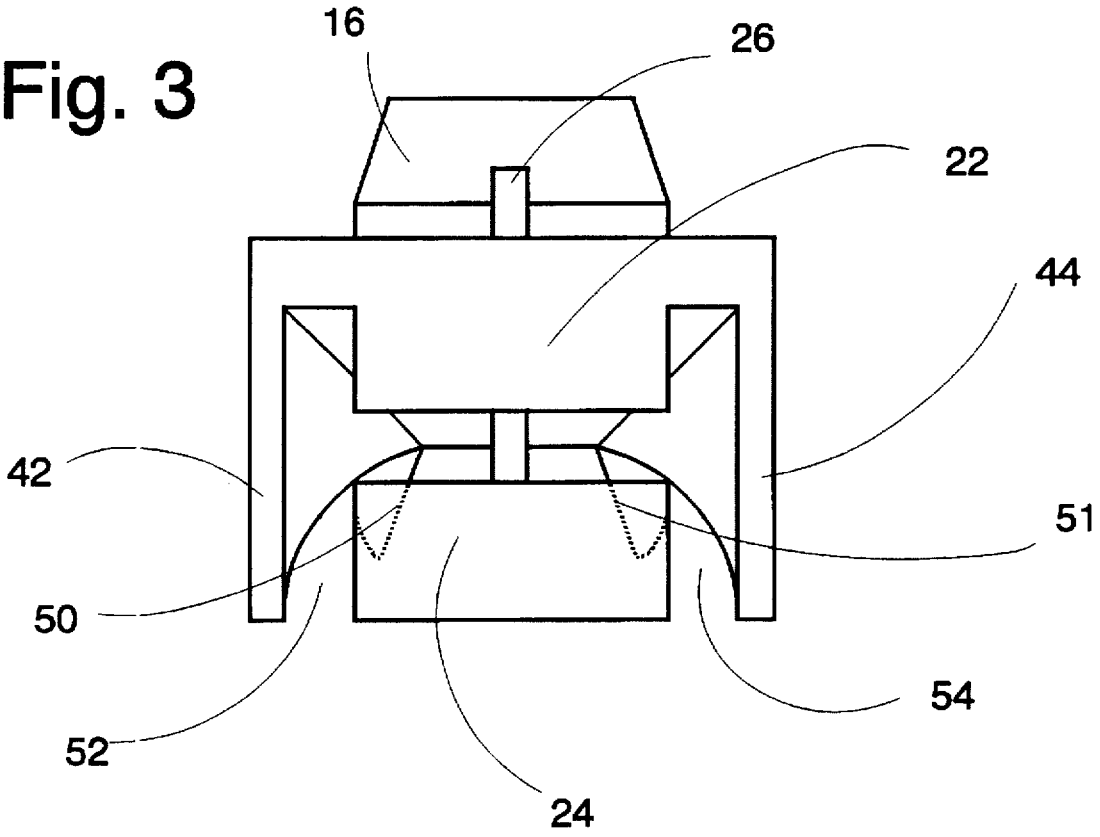
FIG. 3 is a second end view of the first alternative embodiment.
Figure 4:
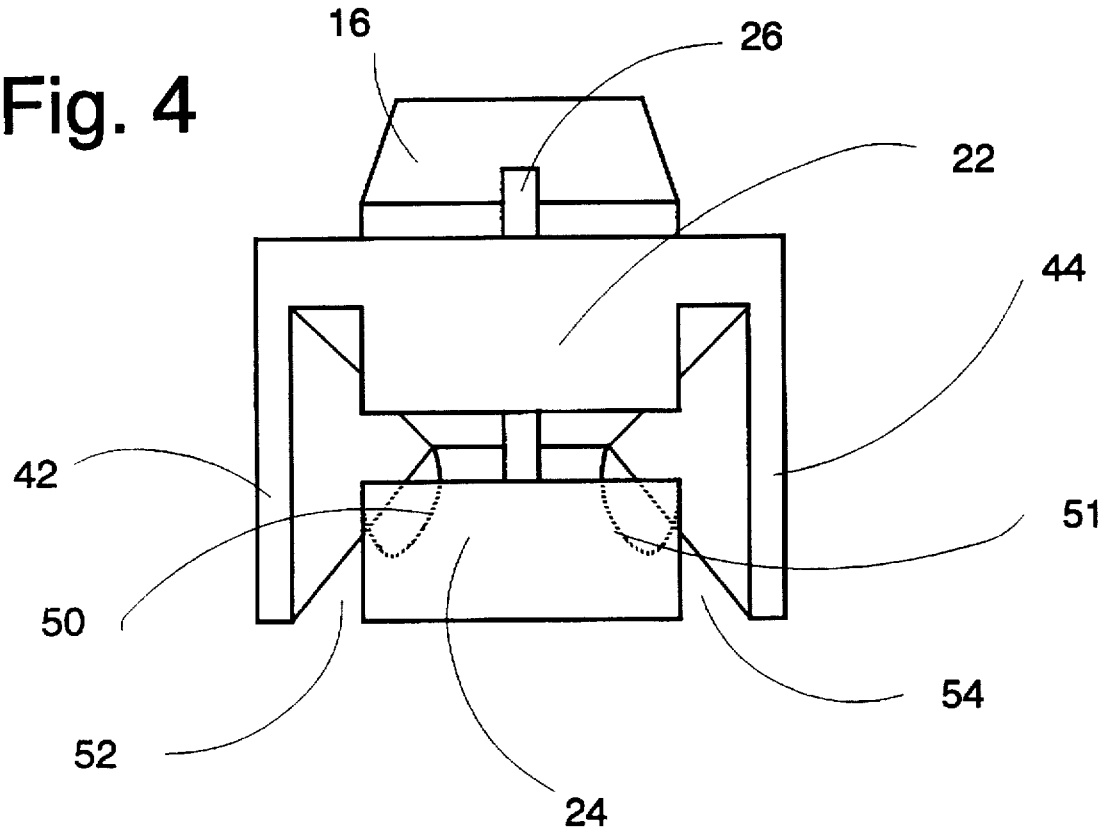
FIG. 4 is a second end view of the second alternative embodiment.
Figure 5:
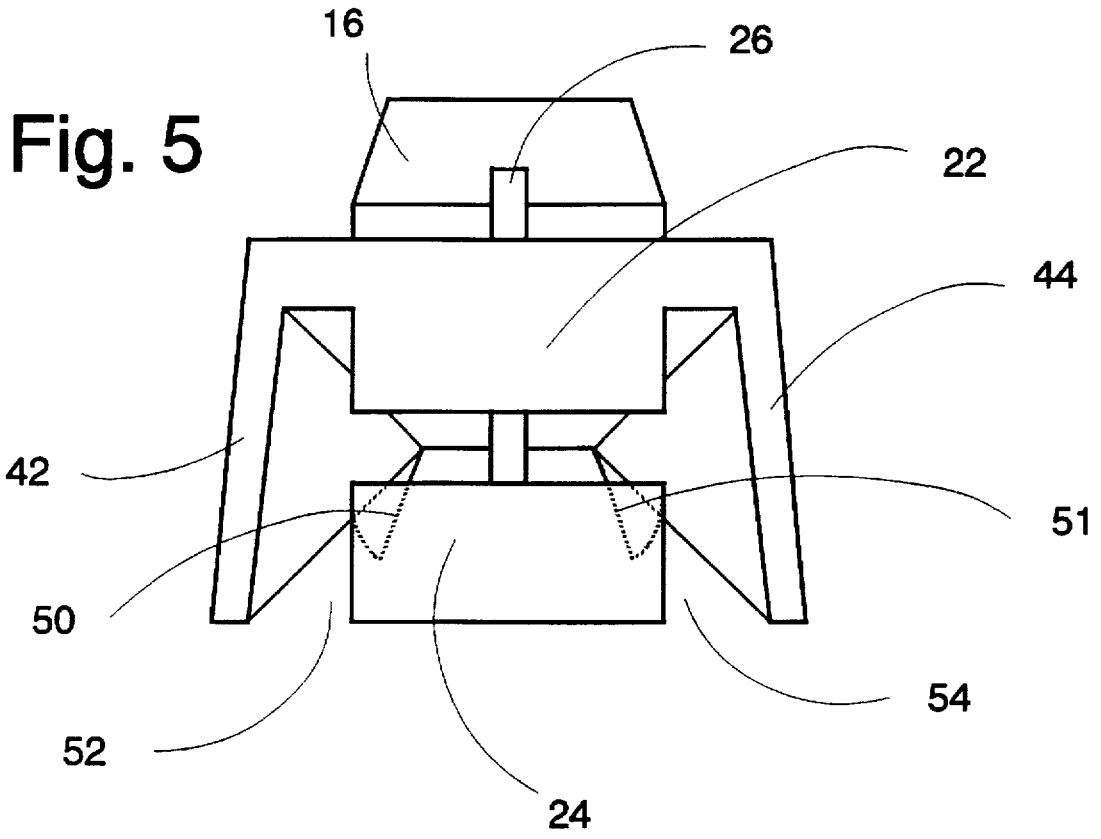
FIG. 5 is a second end view of the third alternative embodiment.
Figure 6:
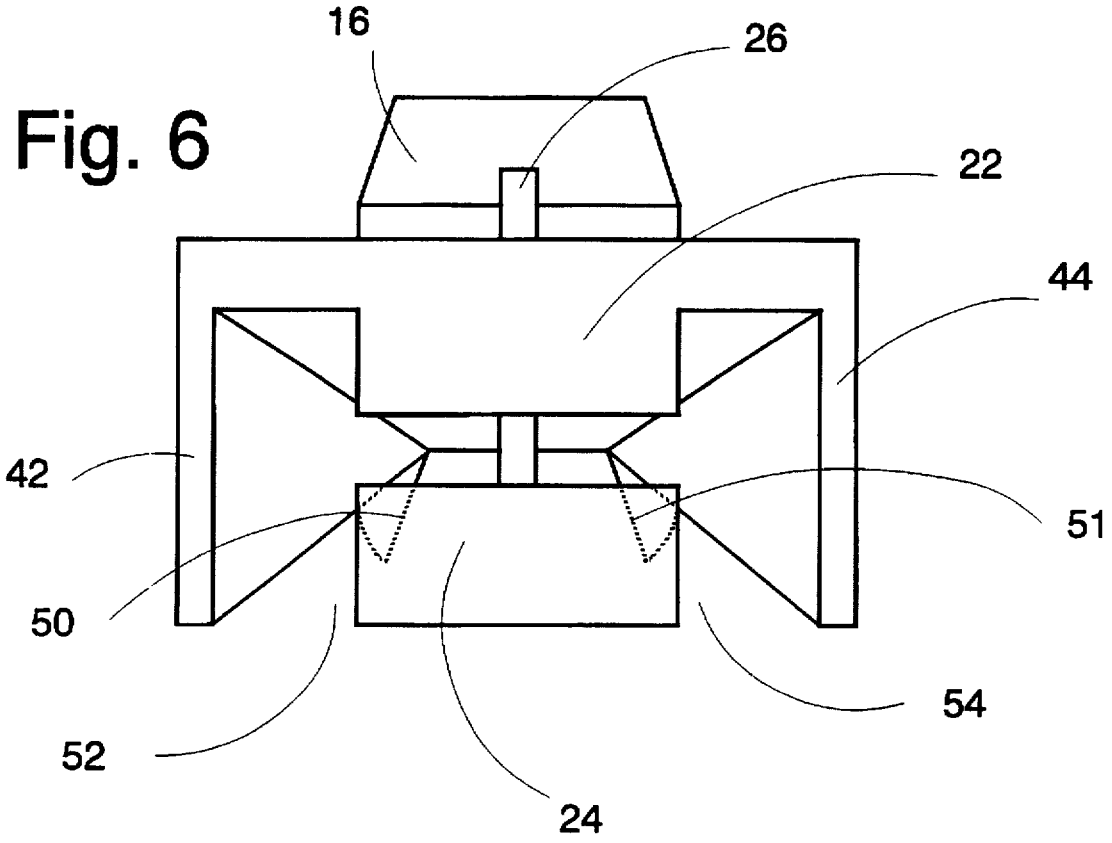
FIG. 6 is a second end view of the fourth alternative embodiment.

The degree of convexity of the sides of the upper elongated member 42, 44 and the degree of the concavity of the lower member edge 50, 51 relief cuts are variable and complementary. Thus the key element and consistent theme of the preferred and alternative embodiments is the provision of sides to direct the flow of cut nails in conjunction with an opening between the sides of the upper member and the edges of the lower member. In the first alternative embodiment, as shown in FIG. 3, the sides 42, 44 are convex and the edges 50, 51 of the lower member 14 are straight with no relief cuts. For simplicity of presentation, in FIGS. 3, 4, 5, and 6 the lever 16 is shown rotated about the axis A of the post 26 and laid along the upper elongated member 12. In the second alternative embodiment, as shown in FIG. 4, the sides 42, 44 are straight and the edges 50, 51 of the lower member 14 are concave. In the third alternative embodiment, as shown in FIG. 5, the sides 42, 44 are straight, though flared and the edges 50, 51 of the lower member 14 are straight with no relief cuts. In the fourth alternative embodiment, as shown in FIG. 6, the sides 42, 44 are straight and the edges of the lower member 50, 51 are straight and the upper member is wider than the lower member.

Although the description above contains many specificities, these should not be construed as limiting the scope of the invention but as merely providing illustrations of some of the presently preferred embodiments of this invention. For example, the nail clipper may also have flared sides as discussed in the fourth alternative embodiment in conjunction with concave relief cuts on the edges of the lower member, etc. The common thread, and the focus of this invention is the provision of sides for directing the flow of cuts nails in conjunction with the provision of side openings to allow their unimpeded passage.

As will be apparent to those skilled in the art, numerous modifications may be made within the spirit and scope of the above described invention.

I claim:

1. A nail clipper and a discharge directing means for cutting nails and directing their discharge comprising upper and lower elongated members, each having first and second ends, said upper and lower elongated members being joined together at said first end such that said second ends oppose one another in spaced apart relationship, at least one of the second ends being movable toward the other;

a cuttings means at said second end of at least one of said upper and lower elongated members for cutting a nail when said second ends of said upper and lower elongated members are brought into contact with the nail;

said discharge directing means comprising: sides integrally formed or attached to said upper elongated member making said upper elongated member and sides generally "U-shaped"; said lower elongated member and said sides of said upper elongated member so formed and operationally located that when the upper and lower members' second ends are in contact with one another clipped nails cannot exit the nail clipper in a horizontal or upward direction; an opening between said lower elongated member and said sides of said upper elongated member through which clipped nails may pass out of the nail clipper in a downward direction when the upper and lower members' second ends are in contact with one another, whereby nails may be clipped and the discharge of clipped nails controllably directed downward.

* * * * *